US007462141B1

(12) United States Patent
Raboin et al.

(10) Patent No.: US 7,462,141 B1
(45) Date of Patent: Dec. 9, 2008

(54) ADVANCED RESISTIVE EXERCISE DEVICE

(75) Inventors: Jasen L. Raboin, League City, TX (US); Jason Niebuhr, League City, TX (US); Santana F. Cruz, Houston, TX (US); Christopher D. Lamoreaux, Stanford, CA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 794 days.

(21) Appl. No.: 11/031,942

(22) Filed: Jan. 6, 2005

(51) Int. Cl.
*A63B 21/008* (2006.01)
*A63B 21/22* (2006.01)

(52) U.S. Cl. ..... 482/112; 482/110; 482/137; 482/908

(58) Field of Classification Search ..... 482/92, 482/97, 110–113, 133–138, 908; D21/673, D21/692
See application file for complete search history.

(56) References Cited

U.S. PATENT DOCUMENTS

| | | | | |
|---|---|---|---|---|
| 3,481,198 | A * | 12/1969 | Williams | 482/113 |
| 3,638,941 | A * | 2/1972 | Kulkens | 482/113 |
| 4,254,950 | A * | 3/1981 | Baumann | 482/112 |
| 4,257,593 | A | 3/1981 | Keiser | |
| 4,258,913 | A * | 3/1981 | Brentham | 482/45 |
| 4,353,547 | A * | 10/1982 | Jenkinson | 482/113 |
| 4,426,077 | A * | 1/1984 | Becker | 482/92 |
| 4,576,377 | A * | 3/1986 | Wolff | 482/113 |
| 4,650,185 | A * | 3/1987 | Cartwright | 482/97 |
| 4,709,923 | A * | 12/1987 | Gibson | 482/138 |
| 4,863,161 | A * | 9/1989 | Telle | 482/97 |
| 5,785,635 | A * | 7/1998 | Gerschefske et al. | 482/133 |
| 5,951,449 | A * | 9/1999 | Oppriecht | 482/113 |
| 6,027,429 | A | 2/2000 | Daniels | |
| 6,083,143 | A | 7/2000 | Maresh | |
| 6,095,955 | A * | 8/2000 | Lee | 482/112 |
| 6,436,006 | B1 | 8/2002 | Zemlyakov et al. | |
| 6,527,680 | B1 | 3/2003 | Maresh | |
| 6,599,223 | B2 | 7/2003 | Wang et al. | |
| 6,612,170 | B2 | 9/2003 | Brown | |
| 6,685,607 | B1 * | 2/2004 | Olson | 482/142 |
| 2002/0025890 | A1 | 2/2002 | Keiser | |
| 2002/0025891 | A1 | 2/2002 | Colosky, Jr. et al. | |
| 2003/0153438 | A1 | 8/2003 | Gordon et al. | |
| 2005/0101464 | A1 * | 5/2005 | Campitelli | 482/142 |

FOREIGN PATENT DOCUMENTS

| | | | |
|---|---|---|---|
| EP | 155415 | A1 * | 9/1985 |
| GB | 2267224 | A * | 12/1993 |

* cited by examiner

*Primary Examiner*—Loan H Thanh
*Assistant Examiner*—Victor K Hwang
(74) *Attorney, Agent, or Firm*—Theodore U. Ro

(57) ABSTRACT

The present invention relates to an exercise device, which includes a vacuum cylinder and a flywheel. The flywheel provides an inertial component to the load, which is particularly well suited for use in space as it simulates exercising under normal gravity conditions. Also, the present invention relates to an exercise device, which has a vacuum cylinder and a load adjusting armbase assembly.

13 Claims, 7 Drawing Sheets

ADVANCED RESISTIVE EXERCISE DEVICE

ORIGIN OF THE INVENTION

The invention described herein was made by employees of the United States Government and may be manufactured and used by or for the Government of the United States of America for governmental purposes without the payment of any royalties thereon or therefor.

BACKGROUND OF THE INVENTION

1. Field of the Invention

The present invention generally relates to an exercise device and methods for use. More particularly, a first aspect of the present invention relates to an exercise device, which has loads applied by both a vacuum cylinder and a flywheel. This first aspect of the present invention is useful in zero or micro gravity for simulating lifting weights under normal gravity conditions and also has terrestrial application advantages. A second aspect of the present invention relates to an exercise device, which has a vacuum cylinder and a load adjusting armbase assembly.

2. Description of the Related Art

Numerous exercise devices have been designed and are on the market. The vast majority of these devices are designed for normal gravity conditions. For example, many devices have been developed of the "weight type" wherein weights are employed in the resistance to the exertion of muscular force. Perhaps the simplest of these are barbells, but a host of machines of this type have been developed which employ weight stacks of a variety of types against which muscular force is exerted in exercising to achieve or maintain muscular development. Machines of the "weight type" suffer from several common deficiencies, which detract from their desirability.

Such machines are normally rather cumbersome and expensive. They do not possess the fidelity of adjustability (i.e., they are limited to the weight stack increments). Perhaps the most obvious aspect of these types of devices is that they are very heavy due to the inherent nature of the use of weight stacks.

The following patents disclose prior art efforts related to the above-described and/or other problems and studies:

U.S. Pat. No. 4,257,593, issued May 24, 1981, to Keiser discloses an exercising device that employs pneumatics in creating resistance to the muscular force exerted during the exercising operation. Keiser's pneumatic system includes an external source of compressed gas, such as compressed air, a reservoir having an internal chamber of adjustable capacity connecting in receiving relation to the gas from the external source, and a means for selecting the volume of the gas in the reservoir.

U.S. patent application Ser. No. 09/945,026, filed Aug. 31, 2001, to Keiser discloses an exercising device that employs pneumatics in creating resistance to the muscular force exerted during an exercising operation that permits upper and lower body musculature to be exercised simultaneously. Keiser's pneumatic system includes a major and minor pneumatic cylinder assembly, an air compressor, an air compressor accumulator, and pneumatic circuit for interconnectivity purposes. As with '593 to Keiser, this design relies on an external source of compressed gas and a gas reservoir.

U.S. patent application Ser. No. 09/931,142, filed Aug. 16, 2001, to Colosky Jr., et al. discloses a gravity-independent exercise unit designed for use in micro gravity, or on the ground, as a means by which to counter muscle atrophy and bone degradation due to disuse or misuse. Colosky's exercise device utilizes at least one modular resistive "pack," each pack containing at least one constant force torque spring. Each torque spring is "wound up" upon a separate storage drum within the pack and each spring is attached to a single output drum. Each output drum is attached to an output shaft and each output shaft is mechanically connected to a cable drum. There is also a series of mechanical selection devices to select the amount of resistance. The unit is compact and of low mass. However, the complexity and number of internal mechanisms necessary for Colosky's design is less than optimal. Hence, maintenance issues arise, particularly in a micro gravity environment wherein it is undesirable to have a large number of internal parts with the potential of these parts "floating" around in an unmanageable manner.

U.S. Pat. No. 5,226,867, issued Jul. 13, 1993, to Beal discloses a user-manipulated modular exercise machine with two reel assemblies, each including a spirally-wound spring with applies to the real a reactive torque of changing magnitude as the reel rotates in response to pulling input forces applied to a pull-cord by the user. A cam-operated spring compensating mechanism provides for essentially a constant force during operations in various exercise modes.

There are a number of shortcomings with the prior art exercise devices, and particularly those designed for use in zero or micro gravity. Exercise devices for use in space should be compact with minimal mass and mechanical parts, provide for a large number of different exercises, be adjustable for different loads, be adjustable for different sized individuals, operate for long periods with minimal maintenance, and produce a measurable constant force during exercise. Also, it is preferred that the exercise device simulates exercising under normal gravity conditions wherein all of the aforementioned characteristics are applicable. Prior art exercise devices have failed to meet these criteria.

SUMMARY OF THE INVENTION

Accordingly, a need has arisen for an exercise device for zero or micro gravity conditions which, for example, simulates the lifting of free weights in a 1-g environment and which is compact with relatively low mass, provides for numerous different exercises, is adjustable for different loads, is adjustable for different sized individuals and will operate for long periods with minimal maintenance.

In accordance with the present invention, an exercise device is provided which has loads applied by both a vacuum cylinder and a flywheel. When used in a space application, this device simulates the lifting of free weights in a 1-g environment.

Also in accordance with the present invention, an exercise device is provided which comprises a vacuum cylinder and a load adjusting armbase assembly.

Accordingly, an object of the present invention is to provide an exercise device for space application, which simulates the lifting of free weights in a 1-g environment.

Accordingly, a second object of the present invention is to provide an exercise device having a vacuum cylinder and a unique load-adjusting feature, which varies the otherwise constant load provided by a vacuum cylinder.

A third object of the present invention is to provide an improved exercising apparatus for terrestrial applications such as, for examples: a home gym for personal use; rehabilitation and physical therapy purposes; and an exercise device for a health club, hotel, or cruise ship.

Further objects and advantages are to provide improved elements and arrangements thereof in an exercise apparatus for the purpose described which is dependable, economical, durable, and fully effective in accomplishing the intended purpose.

BRIEF DESCRIPTION OF THE DRAWINGS

A better understanding of the invention can be obtained when the detailed description of exemplary embodiments set forth below is considered in conjunction with the attached drawings in which.

DETAILED DESCRIPTION OF THE EXEMPLARY EMBODIMENTS

Figure 1:
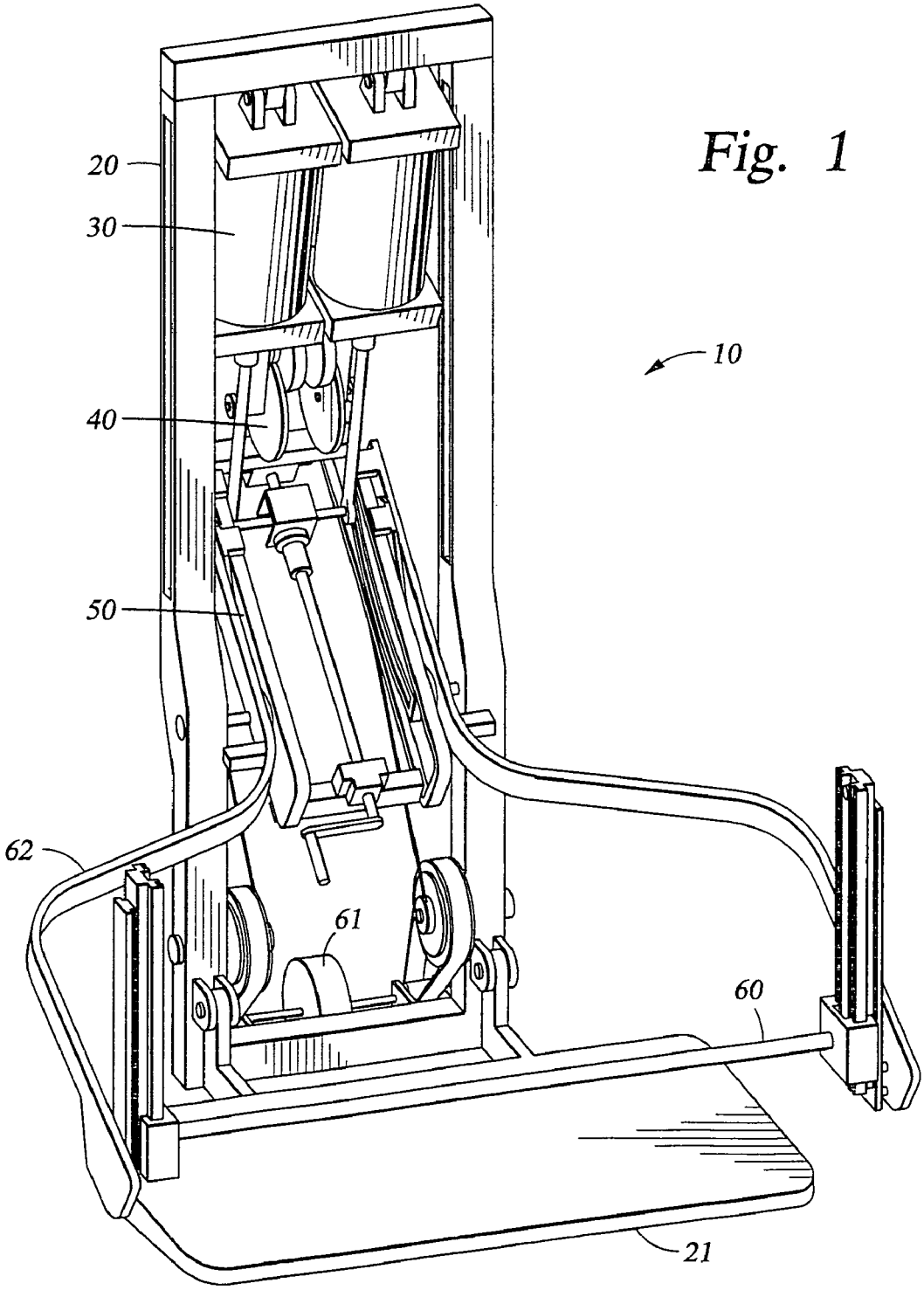
FIG. 1 shows the overall exercise device.

The present invention relates to an exercise device 10, which has loads applied by both a vacuum cylinder 30 and a flywheel 40. As shown in FIG. 1, the exercise device 10 has five main components: a frame 20 including a platform 21, at least one vacuum cylinder 30, at least one flywheel 40, an armbase assembly 50, and a user interface such as a wishbone arm 62/lift bar 60 combination.

In an embodiment, the exercise device's 10 main load is a pair of 8-inch internal diameter vacuum cylinders 30. However, any size vacuum cylinder can be used such that the size is commensurate with the overall design of an exercise device consistent with the elements described herein. The vacuum cylinders 30 provide the necessary resistance for exercise. The vacuum cylinders 30 operatively connect to the frame 20 and to the armbase assembly 50. The flywheel's 40 purpose is to provide the user 11 with the inertial component of free weight exercise, which is currently absent from other exercise devices designed for use in a micro gravity environment. The armbase assembly 50 services as the load adjustment mechanism for the exercise device 10 and is part of the overall load path. The wishbone arm 62 and lift bar 60 serve as an exercise interface for the user 11 of the exercise device 10 and allows the user 11 to perform exercises such as the squat, dead lift, heal raise, and many others. Besides being able to perform bar exercises, the user 11 can also perform pulley exercises such as arm flys and hip abductions with the cable/pulley mechanism 61. Thus, the present invention provides for numerous different exercises.

With reference to FIG. 1, in one embodiment, the at least one vacuum cylinder 30 is a modified industry pneumatic cylinder. In a second embodiment, the at least one vacuum cylinder 30 is a modified off-the-shelf hydraulic cylinder from Parker Hannifin Corporation, Des Plaines, Ill. Each vacuum cylinder 30 provides a maximum constant force of about 750 lbs with a perfect vacuum pulled on it, although the maximum constant force can be any value subject to the vacuum cylinder design limit. Assuming the exercise device 10 would be used on the International Space Station or in a like space vehicle, the vacuum cylinders 30 have few moving parts to wear out or malfunction, they are lightweight, they do not require an external source of compressed gas for normal use, and they do not require any external power. In one embodiment, the vacuum cylinders 30 are self-lubricating. In another embodiment, the vacuum cylinders 30 are self-enclosed. Also, the vacuum cylinders 30 contain no stored energy or chemicals that would be hazardous in failure and the vacuum cylinders 30 can be easily recharged (vacuum achieved) if needed with on-board vacuum pumps.

With continued reference to FIG. 1 and reference to FIGS. 3A, 3B, 4A, and 4B, the purpose of the flywheel 40 is to provide the inertial component of exercise.

While the vacuum cylinders 30 provide the constant load component, the flywheels 40 simulate the inertial component of 1-g exercises that occurs during the motion of free weights. As is discussed further below, this is done using a simple gearing mechanism and a rotating mass, i.e., the flywheels 40. A gear rack 32 is attached to the cylinder shaft 31 and it interfaces with the flywheel gear train 41. The gear rack 32 causes the flywheel 40 to rotate with the movement of the lift bar 60. At the top and bottom of each exercise stroke, the flywheel 40 rotation should be stopped. This adds an additional load into the system, which is felt by the user 11 at the lift bar 60. This approximates the loading felt by a user 11 in a 1-g environment.

With continued reference to FIG. 1, the frame 20 is the backbone of the exercise device 10. The frame 20 supports all of the other subsystems. Preferably, the frame 20 is made of aluminum but other suitable materials can be used, such as steel as an example. Preferably, the frame 20 is substantially rigid and includes a multiplicity of beams to form a truss system. Multiple embodiments and truss designs exist depending on the objectives and requirements of a particular exercise device. The platform 21 serves to support the user 11 while using the exercise device 10.

Figure 2:
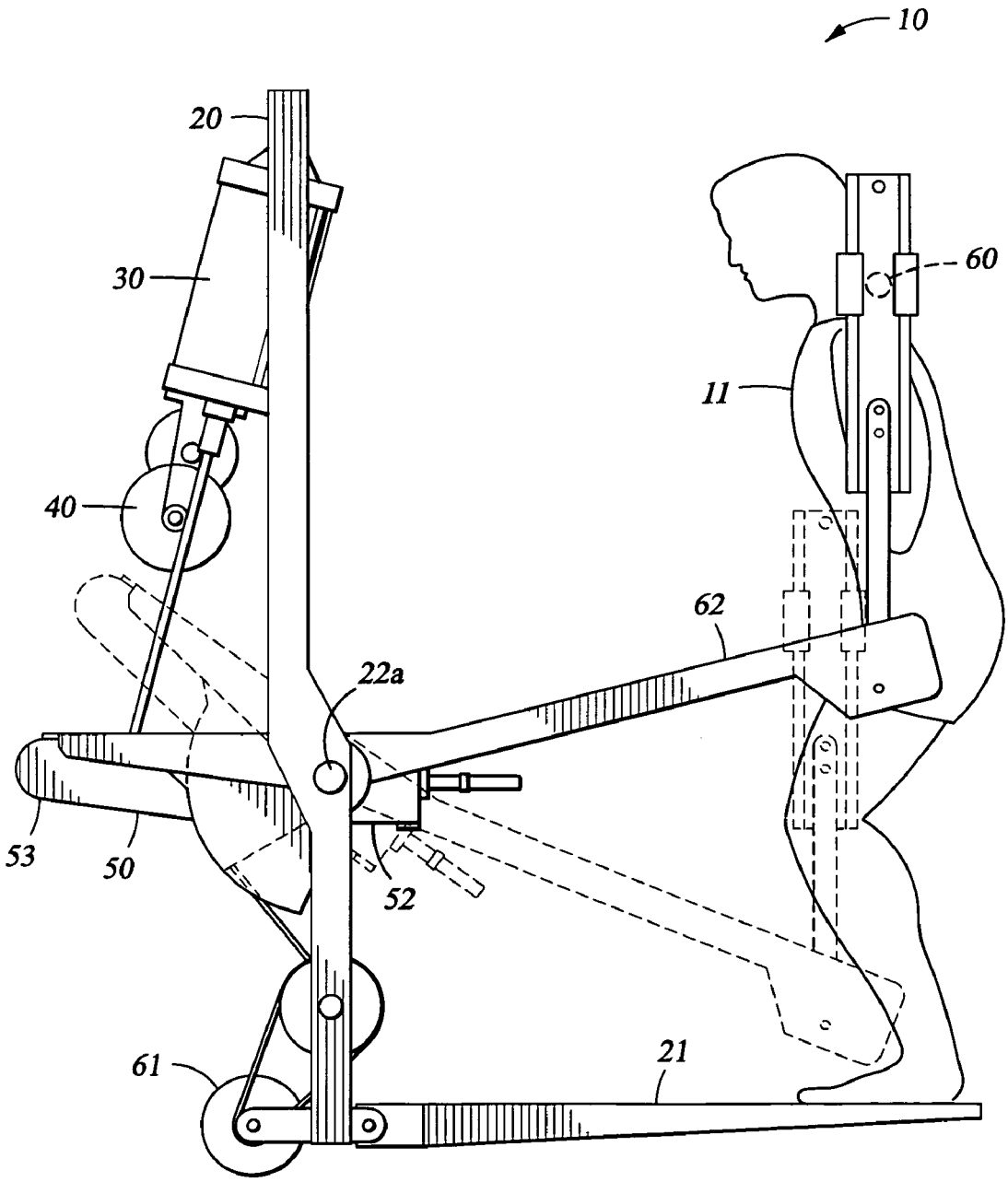
FIG. 2 shows a user using the device for a squat exercise.
Figure 3A:
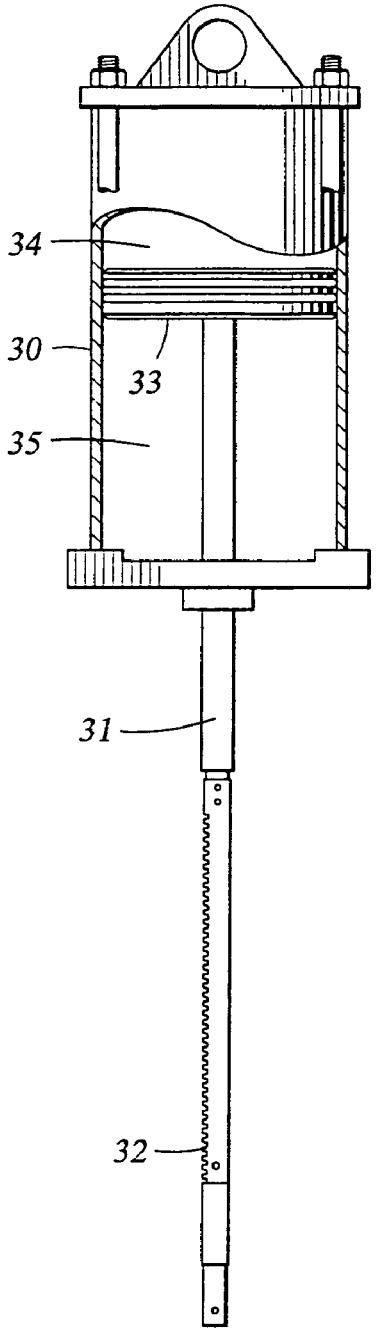
FIGS. 3A and 3B show a cylinder with varying piston and cylinder shaft positions.
Figure 3B:
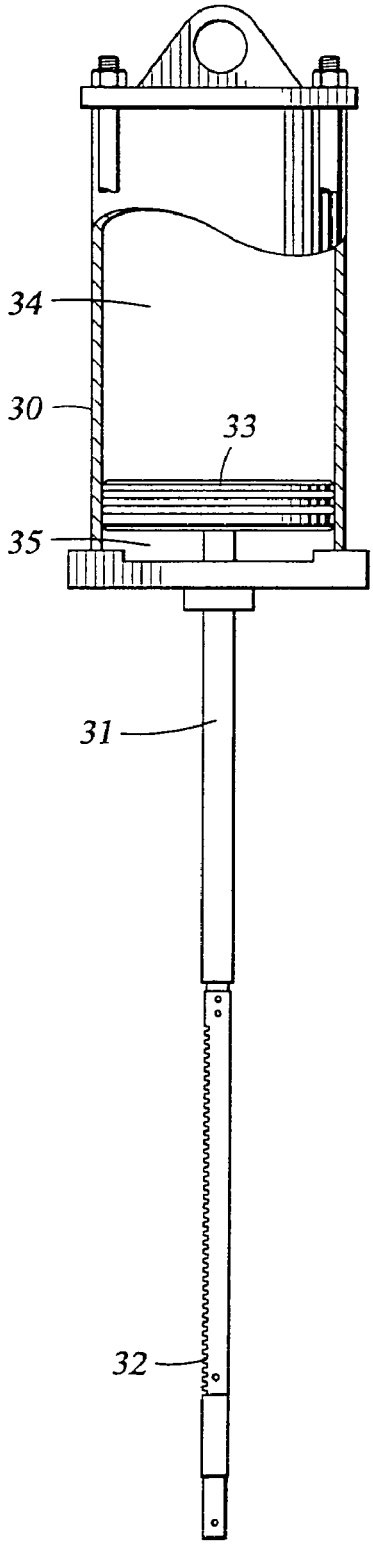

With reference to FIGS. 2, 3A, and 3B, the armbase assembly 50 serves as the load adjustment mechanism and is part of the main load path for the exercise device 10. In this embodiment, the armbase assembly 50 is attached in two locations. It is pinned to the frame 20 at the pivot axis 22*a* and is also pinned to the end of the cylinder shafts 31. The armbase assembly 50 uses the lever principle to provide the required range of exercise loads.

Figure 5:
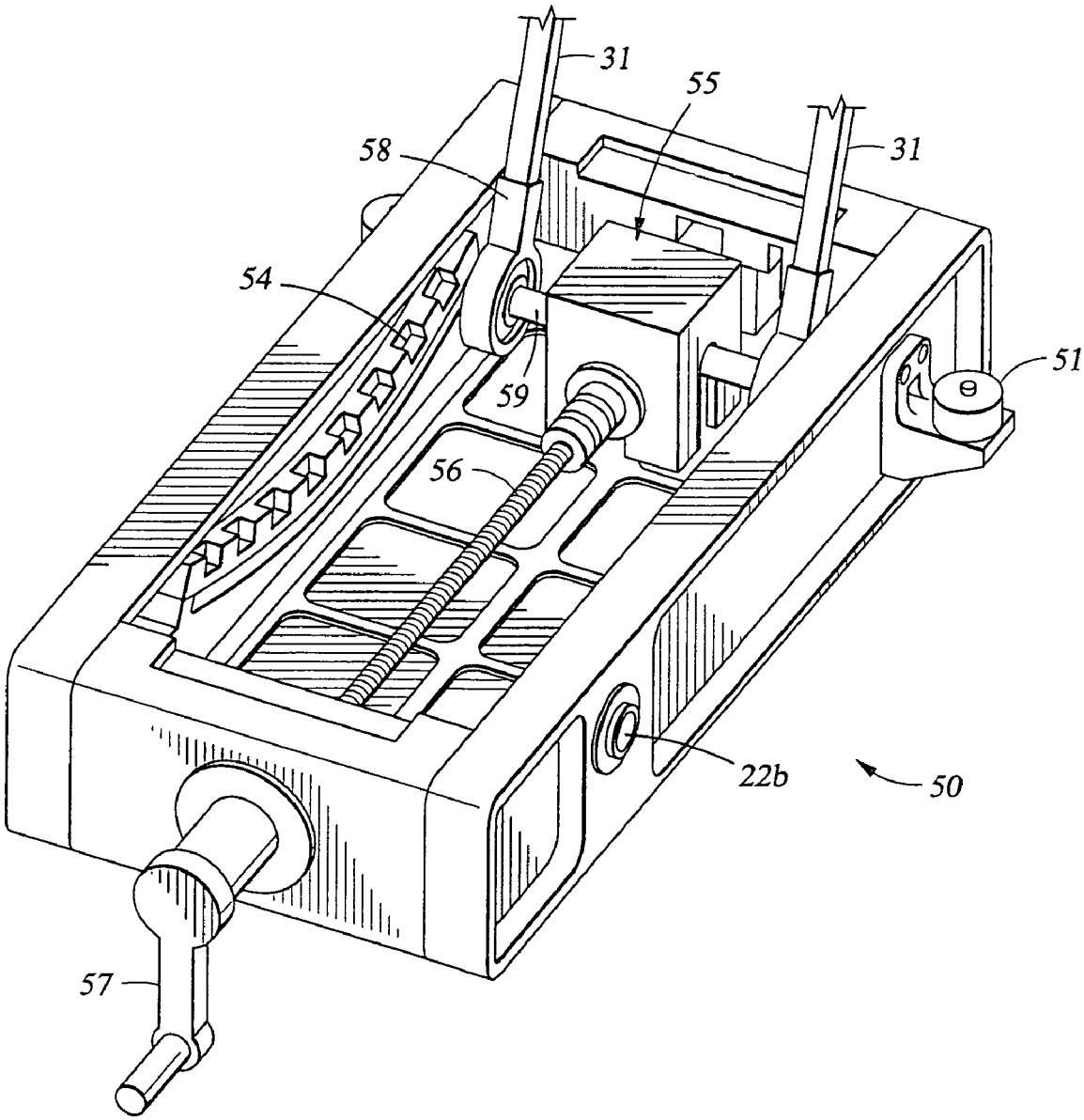
FIG. 5 shows the components of the armbase assembly.

With reference to FIGS. 1 and 5, the wishbone arm 62 is the interface between the armbase assembly 50 and the user 11 using lift bar 60. The main purpose of the wishbone arm 62 is to transfer the load from the armbase assembly 50 to the lift bar 60. The total length of the wishbone arm 62 from the main pivot axis 22*b* to its end is preferably about 40 inches, but this dimension is scaleable depending on a specific design. The mechanical advantage between the armbase assembly 50 with its slider mechanism 55 (discussed below) and the end of the wishbone arm 62 gives the exercise device 10 the ability to provide loading of preferably from about 0 to about 600 lbs at the lift bar 60. The load range is scaleable depending on a specific design. Preferably, the wishbone arm 62 will allow for a maximum stroke of about 30 inches, but this dimension is scaleable depending on a specific design. Preferably, the wishbone arm 62 is made from aluminum, but other suitable materials can be used such as steel as an example.

With continued reference to FIG. 1, the lift bar's 60 main purpose is to provide the exercise interface for the user 11 of the exercise device 10. In an embodiment, the lift bar 60 is adjustable in discrete increments from a low dead lift starting position to a high squat starting position. The position of the lift bar is adjustable in discrete increments with a simple quick release mechanism. Thus, the lift bar 60 provides for numerous different exercises and is adjustable for different sized individuals.

Figure 6A:
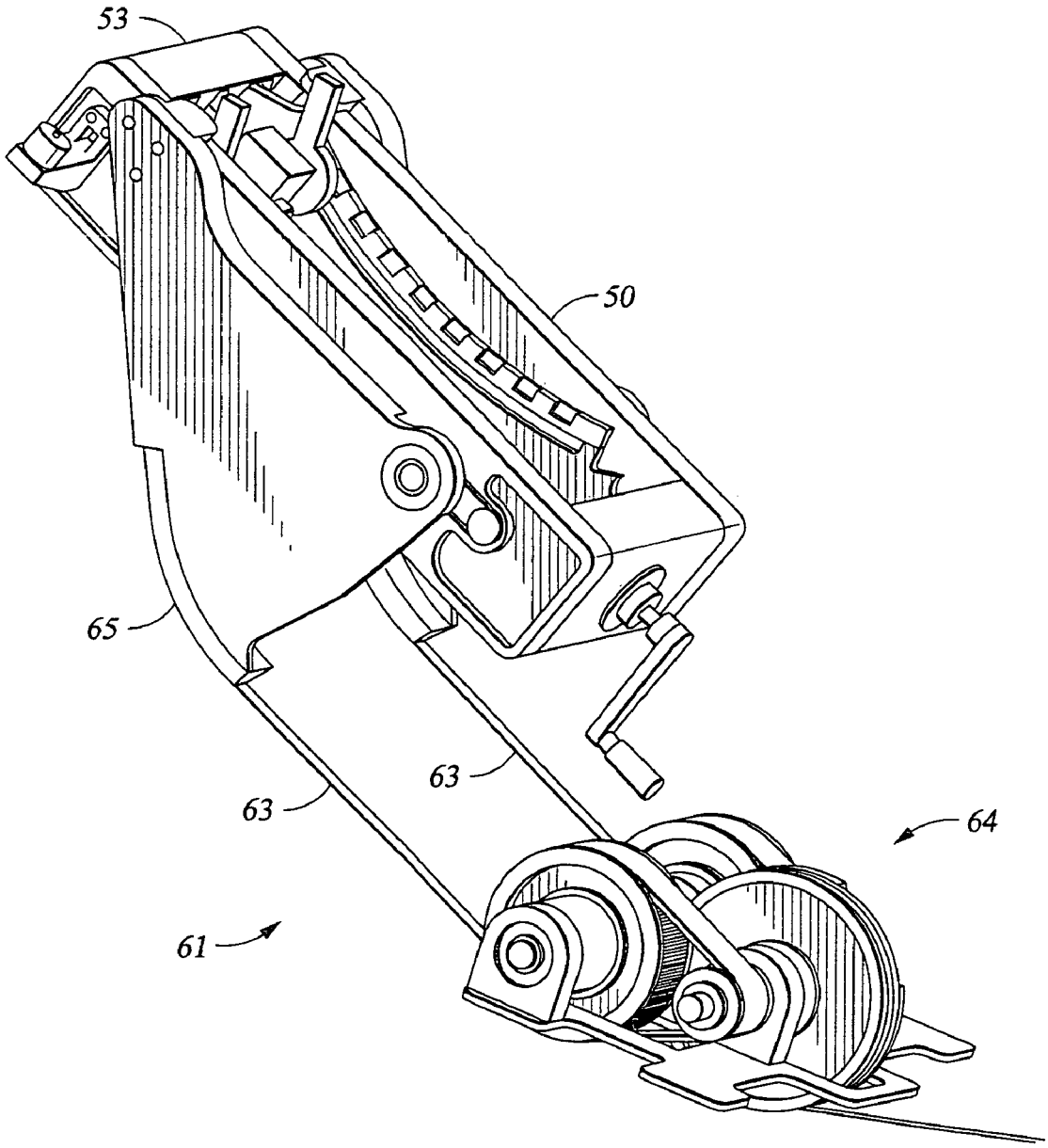
FIGS. 6A and 6B show the cable/pulley mechanism.

With reference to FIG. 6A, the main purpose of the cable/pulley mechanism 61 is to provide long stroke lower load exercise capability. The cable/pulley mechanism also provides a coupling means in the overall load path. The load setting is adjusted by the armbase assembly 50. In one embodiment, the cable 63 is operatively connected to a series of pulleys 64 which have the appropriate ratios to give the desired load at the end of the cable 63. As used herein, "cable" means collectively, steel or fiber rope, cord, belts, or any coupling means commonly known in the art. The cable 63 will then exit from the bottom of the platform 21. In an embodiment, the cable/pulley will have a load capability of from about 0 to about 300 lbs, although this load range is scaleable depending on a specific design. The cable/pulley allows for multiple one-arm, one-legged exercises to be conducted. The cable/pulley mechanism 61 provides a stroke capability of about 45 inches, although this stroke is scaleable depending on a specific design. The cable 63 has the appropriate attachments to enable all desired cable exercise.

Relative to use on the International Space Station or similar space vehicle, the device allows the entire physiological range (i.e., height, weight, proportion, etc.) of a Space Station crew to perform the required resistive exercises to maintain crew health in terms of maintaining muscle and bone density in a microgravity environment. The device of the present invention has a long operational life with high reliability and low maintenance.

Figure 4B:
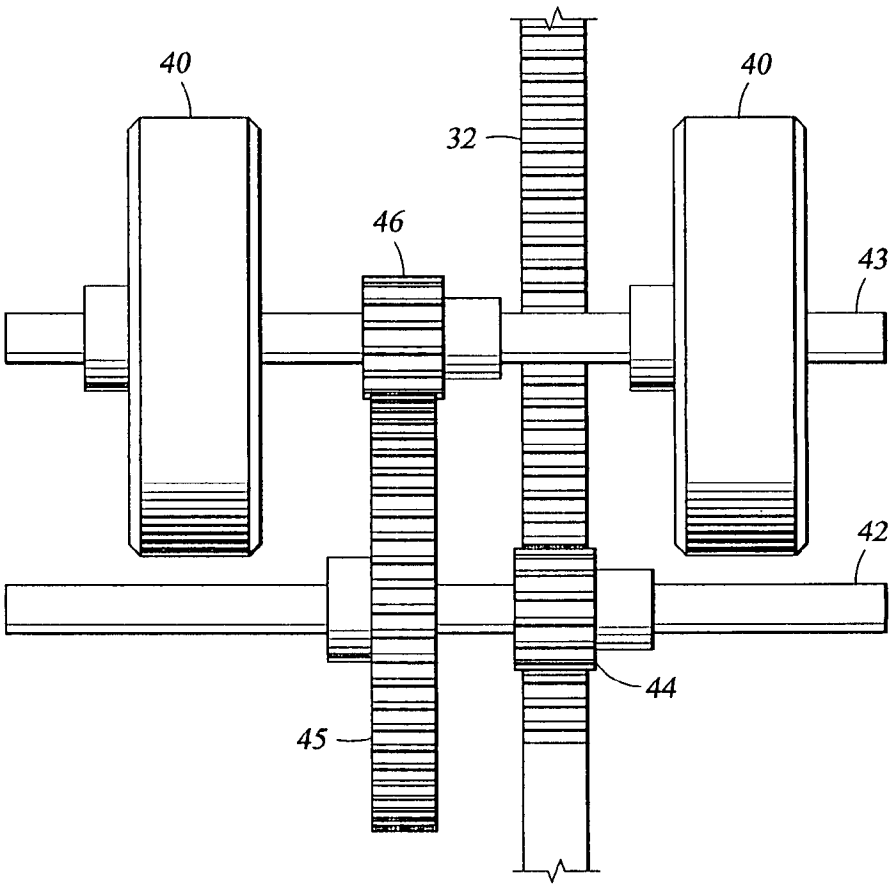
FIGS. 4A and 4B show the flywheel gear train and an attached cylinder.

With reference to FIGS. 4B, 1, and 3A, the angular acceleration of the flywheels 40 introduces a torque on the flywheel gear train 41 that depends on the moment of inertia of the flywheels 40. The torque is transferred back through the flywheel gear train 41 and adds an additional force to the cylinder shaft 31/gear rack 32, which is felt by the user 11 at the lift bar 60.

The present device 10 is useful where a number of people are required to stay fit and where there is a large usage of the machine. With the present device 10, users 11 exercise with one machine instead of a multiplicity of machines. The present device 10 provides for upper and lower body exercises for a user 11.

FIG. 2 shows a user 11 using the exercise device 10 for a squat exercise. (The squat exercise cycle is near completion.) This figure shows that the armbase assembly 50 is connected to the frame 20 at a pivot axis 22*a*. The armbase assembly 50 has a force application end 52 and a shaft connection end 53. When a user lifts the lift bar 60 and wishbone arm 62, the armbase assembly 50 pivots about its main pivot axis 22*b* and the force application end 52 moves upwardly, and the shaft connection end 53 moves downwardly.

FIGS. 3A and 3B show an embodiment of two vacuum cylinders 30, one in mid stroke and the other at full stroke. When a load is applied, the piston 33, cylinder shaft 31, and gear rack 32 all move in a downwardly direction. The piston 33 divides the cylinder's internal space into two variable volume chambers. These variable volume chambers are a vacuum area 34 and an atmospheric pressure area 35. Thus, the load is created by moving the piston 33 downwardly so as to increase the size of the vacuum area 34 and decrease the size of the atmospheric pressure area 35. The cylinder shaft 31 is connected to the piston 33 and extends through the variable atmospheric pressure area 35. The cylinder shaft 31 moves linearly along a stroke axis as the piston 33 slides within the cylinder 30. As illustrated, in FIGS. 3A and 3B, preferably, a "pulling" motion is used to establish the constant resistive force. In another embodiment, a "pushing" motion can be used to establish the constant resistive force. This can be accomplished by switching the locations of the vacuum area and atmospheric pressure area in the vacuum cylinder design. When the exercise is complete, the piston 33, cylinder shaft 31 and gear rack 32 will tend to move upwardly due to the pressure difference on the piston 33. The vacuum cylinders 30 are self-enclosed, require no external source of compressed gas, and require no external power source.

Figure 4A:
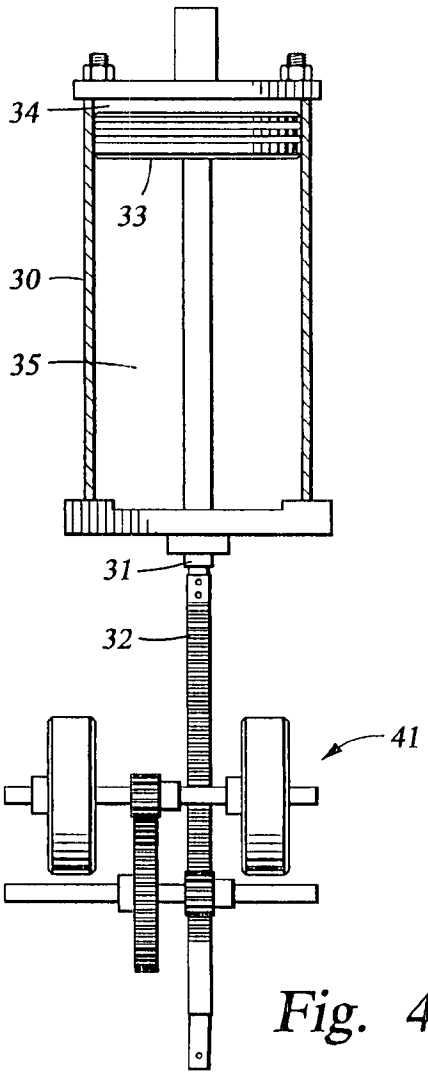

As shown in FIGS. 4A and 4B, the cylinder shaft 31 has an attached gear rack 32, which interfaces with the flywheel gear train 41. The flywheel gear train 41 may be of any design which causes the flywheel 40 to rotate when the cylinder shaft 31 is extended or retracted. For example, the flywheel gear train 41 may consist of at least one rod (for example 42 or 43) having one or more gears (for example 44, 45 or 46), one gear connected to the gear rack 32 such that a rod rotates when the cylinder shaft 31 is extended or retracted and the at least one flywheel 40 is located on the rod, such that when the rod rotates, it causes the flywheel 40 to rotate. In an embodiment, the flywheel gear train 41 consists of: a rotatable first rod 42 having a spur gear 44 and a first helical gear 45, wherein the spur gear 44 connects with the gear rack 32, such that when the cylinder shaft 31 is extended or retracted, the first rod 42 and the first helical gear 45 rotate; and a rotatable second rod 43 having a second helical gear 46 and at least one flywheel 40, wherein the second helical gear 46 contacts the first helical gear 45, such that when the first helical gear 45 rotates, the second rod 43 and the at least one flywheel 40 rotate.

The theory behind the flywheel 40 is as follows: the linear velocity of the piston 33/gear rack 32 is determined by the exercise frequency at the lift bar 60; the piston's 33/gear rack's 32 linear velocity causes a rotational velocity of the spur gear 44 that meshes with the gear rack 32; the rotational velocity causes a rotational velocity and rotational acceleration on the flywheel 40 that depends on the gear ratios of the flywheel gear train 41; the angular acceleration of the flywheel 40 introduces a torque on the flywheel gear train 41 that depends on the moment of inertia of the flywheel 40; and the torque is transferred back through the flywheel gear train 41 and adds an additional force to the cylinder shaft 31/gear rack 32, which is felt by the user 11 at the lift bar 60.

As shown in FIG. 5, the armbase assembly 50 has a number of components, including: two sides, each side having a curved track 54, a slider mechanism 55, a ball screw 56, a crank 57, a shaft end interface 58, a crossbar 59, two tabs 51, and a main pivot axis 22*b*. The cylinder shaft 31 is connected to the slider mechanism 55 at the shaft end interface 58. The slider mechanism's 55 crossbar 59 has two ends, each end located within a curved track 54. The slider mechanism 55 rides along a ball screw 56 and is guided down a curved track 54 in the sides of the armbase assembly 50. The location of the slider mechanism 55 is adjusted with a crank 57 at the end of the ball screw 56. The position of this slider mechanism 55 determines the load exerted at the lift bar 60 or at in the cable/pulley mechanism 61. In an embodiment, the ball screw 56 can adjust the position of the slider mechanism 55 anywhere from the pivot point (main pivot axis 22*b*) (0 load) to about 16.25 inches away from of the pivot point (about 600 lb load setting at the lift bar 60). Also, the ball screw 56 locks so the load does not change during exercise. Still further, the armbase assembly 50 is covered for purposes of lubrication containment and safety. The armbase assembly 50 also interfaces with the wishbone arm 62, the lift bar 60, and the cable/pulley mechanism 61.

Figure 6B:
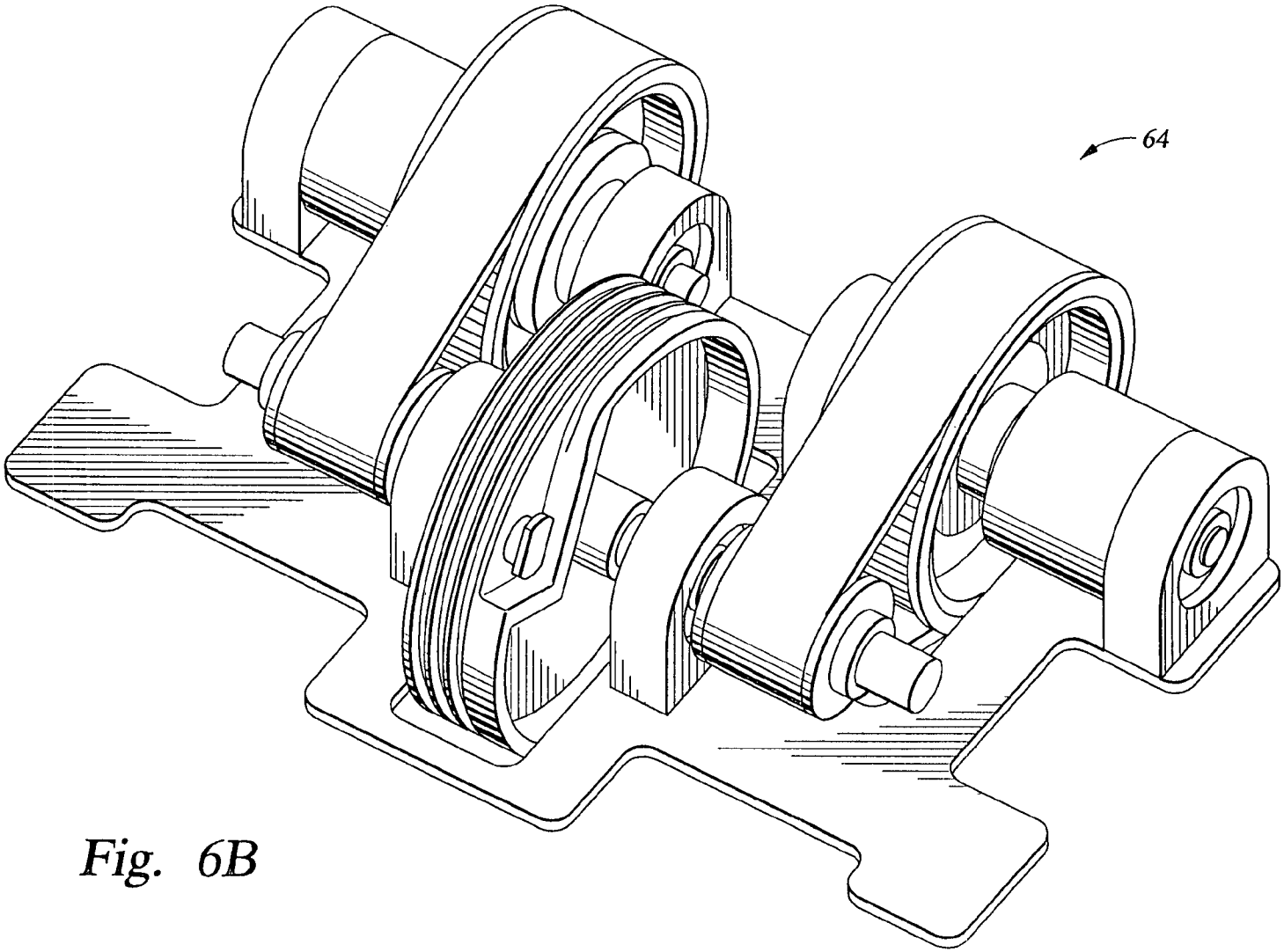

The cable/pulley mechanism 61 is shown in FIGS. 6A and 6B. The cable/pulley mechanism 61 has a cable 63 which is connected, through the pulley 64 mechanism, to two cable arms 65 (one on each side of the armbase assembly 50). The armbase assembly 50 has tabs 51 on its sides. When the cable 63 is pulled, the cable arms 65 pivot and push down on the tabs 51, thus moving the shaft connection end 53 of the armbase assembly 50 downward. This gives the user the ability to easily change between lift bar exercises and cable exercises.

While the present invention is particularly well suited for use in space, it can be used under normal gravity conditions (i.e., terrestrial applications). As in space applications, under normal gravity conditions, the vacuum cylinder 30 provides a constant force without an inertial component. The lifting of free weights has an inertial component of the load. As the flywheel provides an inertial component to the load, even under normal gravity conditions, the exercise device 10 simulates lifting free weights under normal gravity conditions.

In the second aspect of the present invention, the cylinder shaft 31 is directly connected to the armbase assembly 50 without the flywheel gear train 41 being present. The armbase assembly 50 functions in the same manner as in the first aspect of the present invention to vary the load from the vacuum cylinder. With this second aspect, there is no inertial component to the load. In fact, the exercise device 10 is designed such that the flywheel gear train 41 may be disconnected or swung away from the gear track 32 such that the exercise device 10 operates such as described in this second aspect.

The present inventive product is advantageous over known exercise devices for use in space as the present exercise device 10 is compact, provides for a large number of different exercises, is adjustable for different loads, is adjustable for different sized individuals, and can operate for long periods with minimal maintenance. Also, the present exercise device 10, by providing an inertial component to the load, simulates exercising under normal gravity conditions.

Multiple methods exist for using the various embodiments described above. For example, with reference to FIG. 2, when a user 11 desires to simulate a free-weight squat exercise, the user 11 first adjusts the lift bar mechanism 60 to an appropriate location commensurate with the user's 11 height. Next, the user 11 selects the amount of desired resistance using the crank 57 to adjust the location of the slider mechanism 55 in the arm base assembly 50. The user 11 will then position himself/herself at the exercise device 10 in a "start" position. In the case of a squat exercise, the start position is defined such that the user's 11 thighs are substantially parallel to the ground and the lift bar 60 rests upon the user's 11 shoulder/upper back area. The user 11 pushes his/her feet against the platform 21 so that the wishbone arm 62/lift bar 60 and arm base assembly 50 are simultaneously displaced in a smooth, controlled, coordinated movement. During this movement, the vacuum cylinder 30 and flywheel 40 provide the selected constant and inertial components of resistive exercise loads throughout the entire movement. When the user's 11 thighs are substantially perpendicular to the ground, the user 11 pauses any further movement for a short time period. The user 11 next pushes his/her feet against the platform 21 in such as way to reduce the reaction force he/she is applying against the resistive exercise force through the platform 21. Then, the user 11 returns to the "start" position in a smooth, controlled, coordinated movement. Upon reaching the "start" position, the user holds this position for a short amount of time before beginning another exercise cycle.

As another method of use example, in the case of a cable/pulley exercise, the user 11 would first affix the appropriate attachment to the end of the cable 63 for the desired exercise. Next, the user 11 selects the amount of desired resistance using the crank 57 to adjust the location of the slider mechanism 55 on the arm base assembly 50. The user 11 will then perform the desired exercise such as an arm fly or hip abduction.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. An exercise device comprising:

at least one vacuum cylinder, wherein the at least one vacuum cylinder requires no external source of compressed gas, and wherein the at least one vacuum cylinder comprises a cylinder shaft;

at least one flywheel operatively connected to the at least one vacuum cylinder;

a flywheel gear train operatively connected to the cylinder shaft, wherein the flywheel gear train comprises:

at least one rod; and one or more gears operatively connected to the at least one rod such that the at least one rod rotates when the cylinder shaft is extended or retracted, wherein the at least one flywheel is operatively connected to the at least one rod, such that when the at least one rod rotates, it causes the at least one flywheel to rotate; and an armbase slider mechanism means, connected to the cylinder shaft, for varying a resistive exercise load.

2. The device of claim 1, further comprising a frame operatively connected to the at least one vacuum cylinder.

3. The device of claim 2, further comprising a platform connected to the frame.

4. An exercise device comprising:

at least one vacuum cylinder, wherein the at least one vacuum cylinder requires no external source of compressed gas, and wherein the at least one vacuum cylinder comprises a cylinder shaft;

at least one flywheel operatively connected to the at least one vacuum cylinder;

a flywheel gear train operatively connected to the cylinder shaft, wherein the flywheel gear train comprises:

at least one rod; and one or more gears operatively connected to the at least one rod such that the at least one rod rotates when the cylinder shaft is extended or retracted, wherein the at least one flywheel is operatively connected to the at least one rod, such that when the at least one rod rotates, it causes the at least one flywheel to rotate; and an armbase assembly operatively connected to the cylinder shaft, wherein the armbase assembly is comprised of two sides and a slider mechanism slideably connected to the two sides wherein the slider mechanism varies the position of the cylinder shaft of each of the at least one vacuum cylinder relative to the armbase assembly.

5. The device of claim 4, wherein the armbase assembly is further comprised of a pivot axis operatively connected to the armbase assembly such that the armbase assembly pivots about the pivot axis and wherein the armbase assembly has a shaft connection end and a force application end, such that when a force is exerted on the force application end, the armbase assembly pivots about the pivot axis and the shaft connection end causes the cylinder shaft of each of the at least one vacuum cylinder to extend.

6. The device of claim 5, wherein each of the two sides is comprised of a curved track and wherein the armbase assembly is further comprised of:

a ball screw operatively connected to the slider mechanism;

a crank operatively connected to the ball screw;

at least one shaft end interface operatively connected to the cylinder shaft of each of the at least one vacuum cylinder; and a cross bar operatively connected to the slider mechanism and the at least one shaft end interface.

7. The device of claim 4, further comprising a wishbone arm and a lift bar, wherein the wishbone arm is operatively connected to the armbase assembly and the lift bar is operatively connected to the wishbone arm.

8. The device of claim 4, further comprising two cable arms, operatively connected to the armbase assembly on each of its sides.

9. The device of claim 8, further comprising at least two cables, wherein at least one cable is operatively connected to each of the two cable arms.

10. The device of claim 9, further comprising at least one pulley operatively connected to at least one of the at least two cables, wherein the at least one pulley is comprised of a predetermined load ratio for a load application to each of the at least two cables.

11. An exercise device, comprising:

at least one vacuum cylinder comprised of a cylinder shaft;

a gear rack operatively connected to the cylinder shaft;

a rotatable first rod operatively connected to the gear rack, the rotatable first rod having a first helical gear operatively connected to the first rod and a spur gear operatively connected to the first rod wherein the spur gear also operatively connects to the gear rack such that when the cylinder shaft is extended or retracted, the first rod and the first helical gear rotate;

a rotatable second rod operatively connected to the rotatable first rod, the rotatable second rod having at least one flywheel operatively connected to the second rod and a second helical gear operatively connected to the second rod, wherein the second helical gear operatively contacts the first helical gear such that when the first helical gear rotates, the second rod and the at least one flywheel rotate; and an armbase slider mechanism means operatively connected to the cylinder shaft for varying a resistive exercise load.

12. The device of claim 11, further comprising a frame operatively connected to the at least one vacuum cylinder.

13. The device of claim 12, further comprising a platform connected to the frame.

* * * * *